US005766818A

United States Patent [19]

Smith et al.

[11] Patent Number: 5,766,818

[45] Date of Patent: Jun. 16, 1998

[54] TONER PROCESSES WITH HYDROLYZABLE SURFACTANT

[75] Inventors: Paul F. Smith, Toronto; Nan-Xing Hu, Oakville; Beverly C. Dutoff; Beng S. Ong, both of Mississauga; Raj D. Patel, Oakville; Michael A. Hopper, Toronto, all of Canada

[73] Assignee: Xerox Corporation, Stamford, Conn.

[21] Appl. No.: 960,176

[22] Filed: Oct. 29, 1997

[51] Int. Cl.[6] ..... G03G 9/087

[52] U.S. Cl. ..... 430/137

[58] Field of Search ..... 430/137

[56] References Cited

U.S. PATENT DOCUMENTS

| | | | |
|---|---|---|---|
| 4,072,704 | 2/1978 | Langdon . | |
| 4,137,188 | 1/1979 | Uetake et al. . | |
| 4,353,834 | 10/1982 | Langdon . | |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,244,726 | 9/1993 | Laney et al. | 428/312.6 |
| 5,275,647 | 1/1994 | Winnik | 106/22 E |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. . | 430/137 |
| 5,346,797 | 9/1994 | Kmiecik-Lawrynowicz et al. . | 430/137 |
| 5,348,832 | 9/1994 | Sacripante et al. | 430/109 |
| 5,364,729 | 11/1994 | Kmiecik-Lawrynowicz et al. . | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. . | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,650,255 | 7/1997 | Ng et al. | 430/137 |
| 5,650,256 | 7/1997 | Veregin et al. | 430/137 |

*Primary Examiner*—Ronald Martin
*Attorney, Agent, or Firm*—E. O. Palazzo

[57] ABSTRACT

A process for the preparation of toner by mixing a colorant dispersion and a latex emulsion, and wherein the latex emulsion contains resin and a surfactant, wherein the surfactant is, for example, of the Formulas (I) or (II)

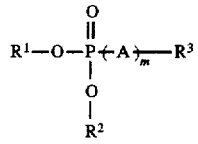

(I)

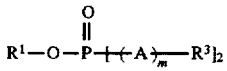

(II)

wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer, and m represents the number of A segments.

32 Claims, No Drawings

TONER PROCESSES WITH HYDROLYZABLE SURFACTANT

PENDING APPLICATION

Illustrated in application U.S. Ser. No. 08/960,754 , entitled "Surfactants", the disclosure of which is totally incorporated herein by reference are novel surfactants, that is cleavable or hydrolyzable surfactants of the Formulas (I), (II), or (III), and which surfactants, especially those of Formulas (I), (II), or mixtures thereof may be selected for the processes of the present invention.

BACKGROUND OF THE INVENTION

The present invention is generally directed to toner processes, and more specifically, to aggregation and coalescence or fusion of latex, colorant, like pigment, dye, or mixtures thereof, and additive particles. In embodiments, the present invention is directed to toner processes which provide toner compositions with, for example, a volume average diameter of from about 1 micron to about 20 microns, and preferably from about 2 microns to about 10 microns, and a narrow particle size distribution of, for example, from about 1.10 to about 1.35 as measured by the Coulter Counter method, without the need to resort to conventional pulverization and classification methods, and wherein washing of the toner permits the latex surfactant selected, which is hydrolyzable, or cleavable, to convert to a substantially inert form, or wherein the surfactant is converted to a form, which is easily removed from the toner, to provide a suitable toner triboelectrical charge, and wherein the removal of the surfactant selected is avoided and washing may not be needed, or wherein washing can be substantially reduced or eliminated. In important embodiments, the present invention relates to the use of cleavable nonionic surfactants, and which surfactants can be readily hydrolyzed by, for example, the addition of base to the surfactant in the pH range of from about 8 to about 13 into, or modified into water soluble components for simple washing thereof and removal from the toner generated. In embodiments, the present invention relates to the selection of cleavable surfactants of the formulas illustrated, or mixtures thereof, in emulsion/aggregation/coalescence processes, and wherein in embodiments such surfactants contain a phosphate ester linkage in the main chain. The resulting toners can be selected for known electrophotographic imaging and printing processes, including digital color processes.

The toners generated with the processes of the present invention are especially useful for imaging processes, especially xerographic processes, which usually require high toner transfer efficiency, such as those with a compact machine design without a cleaner or those that are designed to provide high quality colored images with excellent image resolution, acceptable signal-to-noise ratio, and image uniformity.

PRIOR ART

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process results in the formation of particles with a wide particle size distribution. Similarly, the aforementioned disadvantages, for example poor particle size distributions, are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected; and U.S. Pat. No. 4,558,108, wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

Emulsion/aggregation/coalescense processes for the preparation of toners with optional charge control additives are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners).

The appropriate components and processes of the above Xerox patents can be selected for the processes of the present invention in embodiments thereof.

SUMMARY OF THE INVENTION

It is a feature of the present invention to provide toner processes with many of the advantages illustrated herein.

In another feature of the present invention there are provided simple and economical processes for the preparation of black and colored toner compositions with excellent colorant dispersions, thus enabling the achievement of excellent color print quality.

In a further feature of the present invention there is provided a process for the preparation of toner compositions, with a volume average diameter of from between about 1 to about 15 microns, and preferably from about 2 to about 10 microns, and a particle size distribution of about 1.10 to about 1.28, and preferably from about 1.15 to about 1.25 as measured by a Coulter Counter without the need to resort to conventional classifications to narrow the toner particle size distribution.

In a further feature of the present invention there is provided a process for the preparation of toner by aggregation and coalescence, or fusion (aggregation/coalescence) of latex, pigment, and additive particles, and wherein there is selected a hydrolyzable nonionic surfactant for the latex.

In yet another feature of the present invention there are provided toner compositions with low fusing temperatures of from about 120° C. to about 180° C., and which toner compositions exhibit excellent blocking characteristics at and above about 45° C.

In still a further feature of the present invention there are provided toner compositions which provide high image projection efficiency, such as for example over 75 percent as measured by the Match Scan II spectrophotometer available from Million-Roy.

In embodiments of the present invention there are provided toner processes wherein washing of the toner to eliminate, or substantially remove surfactants is minimized, and wherein in embodiments the surfactant selected, especially for the latex, is a cleavable nonionic surfactant of copending application U.S. Ser. No. 08/960,754, and more specifically, represented by the following Formulas (I) or (II), or mixtures thereof

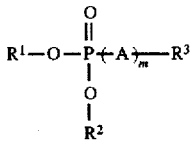

(I)

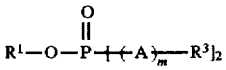

(II wherein $R^1$ is a hydrophobic aliphatic/aromatic group of, for example, alkyl, aryl, an alkylaryl, or an alkylaryl group with, for example, a suitable substituent, such as halogen like fluorine, chlorine, or bromine, wherein alkyl contains, for example, from about 4 to about 60 carbon atoms and aryl contains from, for example, about 6 to about 60 carbon atoms; $R^2$ can be selected from the group consisting of hydrogen, alkyl, aryl, alkylaryl, and alkylarylalkyl wherein each alkyl may contain, for example, from 1 to about 6 carbon atoms; $R^3$ is hydrogen or alkyl of, for example, 1 to about 10 carbon atoms; A is a hydrophilic polymer chain of polyoxyalkylene, polyvinyl alcohols, poly(saccharides), and more specifically, poly(oxyalkylene glycols) being selected, for example, from the group consisting of at least one of the heteric, block or homopolymer polyoxyalkylene glycols derived from the same or different alkylene oxides; wherein m is an integer, or a number of from, for example, about 2 to about 500, or about 5 to about 100, and wherein in embodiments the weight average molecular weight, $M_w$ of A is, for example, from about 100 to about 300, or from about 104 to about 2,500, and which A is available from Aldrich Chemicals.

In the surfactant, formulas Rcan be methylphenyl, ethylphenyl, propylphenyl, butylphenyl, pentylphenyl, hexylphenyl, octylpenyl, or nonylphenyl; $R^2$ can be hydrogen, methyl, ethyl, methylphenyl, or propyl, $R^3$ is hydrogen, methyl, ethyl, propyl, or butyl; A can be polyoxyalkylene glycol, polyethylene glycol, or polypropylene glycol, and wherein $R^1$ is preferably an alkylphenyl such as octylphenyl, $R^2$ is a methyl, $R^3$ is methyl and A is polyethylene glycol. The substituents and specific examples thereof are illustrated in copending application U.S. Ser. No. 08/960,754 More specifically, the cleavable nonionic surfactants selected can be of the Formulas (I), (II), or (III), or mixtures thereof, and preferably of Formulas (I) or (II)

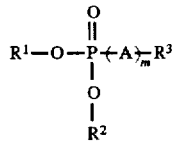

(I)

-continued

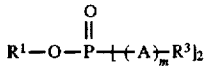

(II)

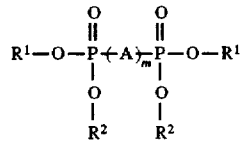

(III)

wherein $R^1$ is a hydrophobic moiety selected from, for example, the group consisting of alkyl, aryl, and their substituted derivatives such as those containing a halogen atom such as fluorine, chlorine or bromine, and wherein the alkyl group contains, for example, from about 4 to about 60, and preferably from about 6 to about 30 carbon atoms, and the aryl group contains, for example, from about 6 to about 60, and preferably from about 10 to about 30 carbon atoms; $R^2$ may be the same as $R^1$ or different, and can be selected from the group consisting of alkyl, aryl, and their substituted derivatives; $R^3$ is hydrogen or alkyl of from, for example, about 1 to about 10, and preferably 1 to about 3 carbon atoms; A is a hydrophilic polymer chain selected, for example, from the group consisting of polyoxyalkylene, poly(vinyl alcohols), poly(saccharides) and the like, and preferably is a polyoxyalkylene derived from the same or different alkylene oxides with from about 2 to about 4 carbon atoms; and m is the number of repeating units of the hydrophilic polymer chain, and can be a number of, for example, from about 2 to about 500, and preferably from about 5 to about 100.

In embodiments, the present invention relates to toner processes, especially emulsion/aggregation/coalescense processes wherein there are utilized in such processes nonionic surfactant compositions of Formulas (I), (II), (III), or mixtures thereof, and which surfactants are comprised of a hydrophobic and a hydrophilic moiety linked together by a phosphate ester linkage, and wherein the nonionic surfactant compositions can be readily decomposed by treatment with a dilute aqueous base solution into water soluble components, which components can be removed from the toner generated by a limited number of washings, thus enabling the provision of toners with excellent charging characteristics. With the presence of the phosphate ester linkage, the surfactant compositions can, for example, be decomposed, or converted into non-surface-active species or into new surface-active derivatives with different molecular properties upon exposure to conditions of, for example, basic medium which promote hydrolytic cleavage of the surfactant molecules.

Specific examples of surfactants are poly(ethylene glycol) methyl p-tert-octylphenyl phosphate, poly(ethylene glycol) -α-methyl ether-ω-methyl p-tert-octylphenyl phosphate, poly(ethylene glycol) methyl decylphenyl phosphate, poly (ethylene glycol)-α-methyl ether-ω-methyl dodecylphenyl phosphate, poly(ethyleneglycol) methyl dodecylphenyl phosphate, bis[poly(ethylene glycol)-α-methyl ether]-ω-p-tert-octylphenyl phosphate, poly(ethylene glycol)-α,ω-methyl p-tert-octylphenyl phosphate, poly(ethylene glycol) ethyl p-tert-octylphenyl phosphate, poly(ethylene glycol)-α-methyl ether-ω-ethyl p-tert-octylphenyl phosphate, poly (ethylene glycol) phenyl p-tert-octylphenyl phosphate, poly (ethylene glycol)-α-methyl ether-ω-phenyl p-tert-octylphenyl phosphate, poly(ethylene glycol) tolyl p-tert-octylphenyl phosphate, poly(ethylene glycol)-α-methyl ether-ω-tolyl p-tert-octylphenyl phosphate, and poly (ethylene oxide-co-propylene oxide) methyl p-tert-octylphenyl phosphate, and preferably wherein the polymer chain contains from about 5 to about 50 repeating units or segments.

Embodiments of the present invention relate to emulsion/aggregation/coalescence processes wherein there are selected cleavable nonionic surfactants of the Formulas (I) or (II) illustrated herein, such as poly(ethylene glycol) methyl p-tert-octylphenyl phosphate, wherein the surfactant contains, for example, preferably about 40 ethylene glycol units, poly(ethylene glycol)-α-methyl ether-ω-methyl p-tert-octylphenyl phosphate wherein the surfactant contains 17 ethylene glycol units or segments, wherein the surfactant is modified or hydrolyzed into a hydrophobic alkylphenol, such as octylphenol, and a hydrophilic polyethylene glycol under basic conditions where the pH is in the range of from about 7 to about 13 and preferably in the range from about 8.5 to about 12.

While not being desired to be limited by theory, a possible reaction scheme for the Formula (I) or (II) hydrolysis, or cleaving could be

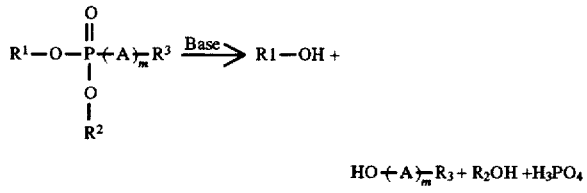

One important advantage of the processes of the present invention is that the hydrolyzable surfactants can be easily removed from the toner surface and water contamination is avoided, or minimized. Also, removal of the surfactant hydrophilic polyethylene glycol chain from the toner surface prevents adsorption of water by this moiety, and hence enables higher toner triboelectric values under, for example, high humidity conditions.

The present invention relates, for example, to processes for the preparation of toner compositions by aggregation/coalescence of latex and colorant, especially pigment particles, and wherein the temperature of aggregation can be selected to control the aggregate size, and thus the final toner particle size, and the coalescence temperature and time can be utilized to control the toner shape and surface properties, and wherein there is selected a cleavable nonionic surfactant as illustrated herein.

Embodiments of the present invention include a process for the preparation of toner comprising mixing a colorant dispersion and a latex emulsion, and wherein the latex emulsion contains resin and a surfactant, and wherein the surfactant is of the Formulas (I) or (II), or optionally mixtures thereof

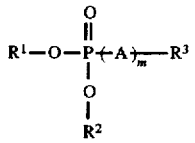

(I)

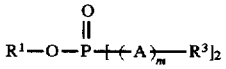

(II)

wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments; a process wherein $R^1$ is a hydrophobic moiety of alkyl or aryl; $R^2$ is selected from the group consisting of alkyl and aryl; and heating below about or equal to about the resin latex glass transition temperature to form aggregates followed by heating above about or equal to about the resin glass transition temperature to coalesce the aggregates; a process wherein $R^1$ is alkyl, m is a number of from about 2 to about 60, said A hydrophilic polymer is a poly(oxyalkylene glycol) selected from the group consisting of a branched polyoxyalkylene glycol, a block polyoxyalkylene glycol and a homopolymeric polyoxyalkylene glycol; a process wherein m is a number of from about 5 to about 60, or from about 10 to about 50; a process wherein the weight average molecular weight of A is from about 100 to about 3,000; a process wherein $R^1$ is methylphenyl, ethylphenyl, propylphenyl, butylphenyl, pentylphenyl, hexylphenyl, octylpenyl, or nonylphenyl, $R^2$ is hydrogen, methyl, ethyl, methylphenyl, or propyl, $R^3$ is methyl, ethyl, propyl, or butyl, and A is polyoxyalkylene glycol, polyethylene glycol, or polypropylene glycol; a process wherein $R^1$ is an alkylaryl group, or an alkylaryl group with a substituent of fluorine, chlorine, or bromine, wherein alkyl contains from about 2 to about 30 carbon atoms; $R^2$ alkyl contains from 1 to about 30 carbon atoms; $R^3$ alkyl contains from 1 to about 3 carbon atoms; and wherein A is a hydrophilic poly(oxyalkylene glycol) selected from the group consisting of a branched, block or homopolymeric polyoxyalkylene glycol derived from alkylene oxides with from about 2 to about 4 carbon atoms; a process wherein the latex resin is generated from the polymerization of monomers to provide a latex emulsion with submicron resin particles in the size range of from about 0.05 to about 0.3 micron in volume average diameter and wherein the latex contains an ionic surfactant, a water soluble initiator and a chain transfer agent; adding anionic surfactant to retain the size of the toner aggregates formed; thereafter coalescing or fusing said aggregates by heating; and optionally isolating, washing, and drying the toner; a process wherein isolating, washing and drying is accomplished; a process wherein said surfactant is mixed with a basic solution in the pH range of from about 8 to about 13; a process wherein said basic medium, or solution is in the pH range of from about 8.5 to about 12; a process wherein $R^1$ is a an alkylaryl, or an alkylaryl group with a substituent of fluorine, chlorine, or bromine, wherein alkyl contains from about 2 to about 30 carbon atoms; $R^2$ is an alkyl containing from about 1 to about 30 carbon atoms; $R^3$ is a hydrogen or an alkyl of from about 1 to about 3 carbon atoms; wherein A is a poly(ethylene glycol); and wherein the molecular weight, $M_w$, of A is from about 104 to about 2,500; a process wherein $R^2$ is an alkylphenyl with an alkyl of about 4 to about 30 carbon atoms, or wherein $R^2$ is an alkyl with from 1 to about 6 carbon atoms; a process wherein said alkylphenyl is an octylphenyl, and $R^2$ is a methyl; a process wherein $R^2$ is hydrogen or methyl, and wherein said poly(ethylene glycol) has a number of repeat units of from about 4 to about 50; a process wherein said surfactant is selected in an amount of from about 0.05 to about 10 weight percent based on the amount of monomer selected to generate said resin latex; a process wherein said surfactant is cleavable, or hydrolyzable, and is selected in an amount of from about 1 to about 3 weight percent; a process wherein the temperature at which said aggregation is accomplished controls the size of the aggregates, and wherein the final toner size is from about 2 to about 15 microns in volume average diameter; a process wherein the aggregation temperature is from about 45° C. to about 55° C., and wherein the coalescence or fusion temperature is from about 85° C. to about 95° C.; a process wherein the colorant is a pigment and wherein said pigment dispersion contains an ionic surfactant, and the latex emulsion contains said surfactant and which surfactant is a cleavable nonionic surfactant of Formulas I or II, and an ionic surfactant of opposite charge polarity to that of ionic surfactant present in said colorant dispersion; a process wherein the surfactant utilized in preparing the colorant dispersion is a cationic surfactant, and the ionic surfactant present in the latex mixture is an anionic surfactant; wherein the aggregation is accomplished at a temperature about 15° C. to about 1° C. below the Tg of the latex resin for a duration of from about 0.5 hour to about 3 hours; and wherein the coalescence or fusion of the components of aggregates for the formation of integral toner particles comprised of colorant, and resin additives is accomplished at a temperature of from about 85° C. to about 95° C. for a duration of from about 1 hour to about 5 hours; a process wherein the latex resin, or polymer is selected from the group consisting of poly(styrene-alkyl acrylate), poly (styrene-1,3-diene), poly(styrene-alkyl methacrylate), poly (styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly (styrene-alkyl acrylate-acrylonitrile-acrylic acid), poly (styrene-1,3-diene-acrylonitrile-acrylic acid), and poly(alkyl acrylate-acrylonitrile-acrylic acid), wherein said resin is present in an effective amount of from about 80 percent by weight to about 98 percent by weight of toner, and wherein said colorant is a pigment; a process wherein the latex resin is selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid), and wherein said colorant is a pigment; a process wherein the anionic surfactant is selected from the group consisting of sodium dodecyl sulfate, sodium dodecylbenzene sulfate and sodium dodecylnaphthalene sulfate; a process wherein the colorant is carbon black, cyan, yellow, magenta, or mixtures thereof; a process wherein the toner particles isolated are from about 2 to about 10 microns in volume average diameter, and the particle size distribution thereof is from about 1.15 to about 1.30, wherein the ionic surfactant utilized represents from about 0.01 to about 5 weight percent of the total reaction mixture; a process wherein there is added to the surface of the formed toner metal salts, metal salts of fatty acids, silicas, metal oxides, or mixtures thereof, each in an amount of from about 0.1 to about 10 weight percent of the obtained toner particles; a process which comprises mixing a resin latex, an ionic surfactant and colorant, and a surfactant of the Formulas (I), or (II); heating the resulting mixture below about, or equal to about the glass transition temperature of the resin; thereafter heating the resulting aggregates above about, or about equal to the glass transition temperature of the resin; and optionally isolating, washing and drying the toner

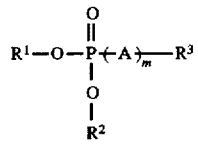

(I)

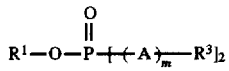

(II wherein $R^1$ is a hydrophobic group; $R^2$ is selected from the group consisting of hydrogen, alkyl, aryl, alkylaryl, and alkylarylalkyl; $R^3$ is hydrogen or alkyl; A is a hydrophilic segment, and m represents the number of A segments; a process wherein said toner is isolated, washed and dried, and said toner is of a volume average diameter of from about 1 to about 20 microns; a process comprising the preparation, or provision of a latex emulsion comprised of resin particles in the size range of from about 0.5 to about 3 microns containing a cleavable or hydrolyzable nonionic surfactant of the Formulas (I), or (II), an ionic surfactant, a water soluble initiator and a chain transfer agent; aggregating a colorant dispersion with said latex emulsion and optional additives to form toner sized aggregates; freezing or maintaining the size of aggregates with an anionic surfactant; coalescing or fusing said aggregates by heating; and isolating, washing, and drying the toner

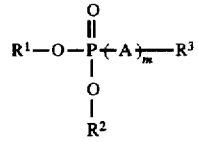

(I)

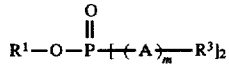

(II wherein $R^1$ is alkyl or aryl; $R^2$ is selected from the group consisting of hydrogen, alkyl and aryl; $R^3$ is hydrogen or alkyl; A is a hydrophilic segment, and m represents the number of A segments; a process for the preparation of toner comprising mixing a colorant dispersion with a latex emulsion, and wherein the latex emulsion contains resin and a surfactant, and wherein the surfactant is represented by Formulas (I), (II) or (III); or optionally mixtures thereof

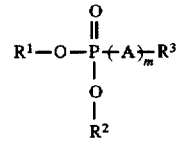

(I)

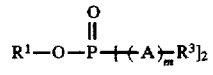

(II)

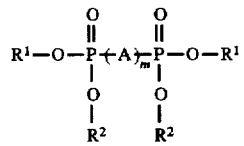

(III)

wherein $R^1$ is a hydrophobic moiety of alkyl or aryl; $R^2$ is selected from the group consisting of alkyl and aryl; $R^3$ is hydrogen or alkyl; A is a hydrophilic polymer chain; and m is the number of repeating segments of the hydrophilic polymer chain A.

The present invention is, more specifically, directed to a process comprised of blending an aqueous colorant, especially pigment dispersion containing an ionic surfactant with a latex emulsion comprised of polymer particles, preferably submicron in size, of from, for example, about 0.05 micron to about 0.5 micron in volume average diameter, a cleavable nonionic surfactant as illustrated herein by the Formulas (I), (II), or mixtures thereof, such as poly(ethylene glycol) methyl p-tert-octylphenyl phosphate, poly(ethylene glycol) -α-methyl ether-ω-methyl p-tert-octylphenyl phosphate and the like, and an ionic surfactant of opposite charge polarity to that of the ionic surfactant in the colorant dispersion, thereafter heating the resulting flocculent mixture at, for example, from about 35° C. to about 60° C. (Centigrade) to form toner sized aggregates of from about 2 microns to about 20 microns in volume average diameter, and which toner is comprised of polymer, colorant, such as pigment and optionally additive particles, followed by heating the aggregate suspension at, for example, from about 70° C. to about 100° C. to effect coalescence or fusion of the components of the aggregates and to form mechanically stable integral toner particles.

The particle size of toner compositions provided by the processes of the present invention in embodiments can be controlled by the temperature at which the aggregation of latex, colorant, such as pigment, and optional additives is conducted. In general, the lower the aggregation temperature, the smaller the aggregate size, and thus the final toner size. For a latex polymer with a glass transition temperature (Tg) of about 55° C. and a reaction mixture with a solids content of about 12 percent by weight, an aggregate size of about 7 microns in volume average diameter is obtained at an aggregation temperature of about 53° C.; the same latex will provide an aggregate size of about 5 microns at a temperature of about 48° C. under similar conditions. Moreover, as illustrated in a related application U.S. Ser. No. 922,437, the disclosure of which is totally incorporated herein by reference, the presence of certain metal ion or metal complexes such as aluminum complex in embodiments enables the coalescence of aggregates to proceed at lower temperature of, for example, less than about 95° C. and with a shorter coalescence time of less than about 5 hours.

In embodiments of the present invention, an aggregate size stabilizer can be added during the coalescence to prevent the aggregates from growing in size with increasing temperature, and which stabilizer is generally an ionic surfactant with a charge polarity opposite to that of the ionic surfactant in the colorant, especially pigment dispersion. In embodiments, the present invention is directed to processes for the preparation of toner compositions which comprises blending an aqueous colorant dispersion preferably containing a pigment, such as carbon black, phthalocyanine, quinacridone or RHODAMINE B™ type, red, green, orange, brown, and the like, with a cationic surfactant, such as benzalkonium chloride, with a latex emulsion derived from the emulsion polymerization of monomers selected, for example, from the group consisting of styrene, butadiene, acrylates, methacrylates, acrylonitrile, acrylic acid, methacrylic acid, and the like, and which latex contains an ionic surfactant such as sodium dodecylbenzene sulfonate and a hydrolyzable nonionic surfactant of the formulas illustrated herein, such as poly(ethylene glycol) methyl p-tert-octylphenyl phosphate, wherein the surfactant contains 40 ethylene glycol units, or poly(ethylene glycol)-α-methyl ether-ω-methyl p-tert-octylphenyl phosphate wherein the surfactant contains 17 ethylene glycol units, and which latex resin is of a size of, for example, from about 0.05 to about 0.5 micron in volume average diameter; heating the resulting flocculent mixture at a temperature ranging from about 35° C. to about 60° C. for an effective length of time of, for example 0.5 hour to about 2 hours to form toner sized aggregates; and subsequently heating the aggregate suspension at a temperature at or below about 95° C. to provide toner particles; and finally isolating the toner product by, for example, filtration, washing and drying in an oven, fluid bed dryer, freeze dryer, or spray dryer, and which washing converts the nonionic surfactant into an inert form; whereby surfactant free toner particles comprised of polymer, or resin, colorant, and optional additives are obtained. In embodiments, the cleavable or reactive surfactant can be selected for the colorant dispersion, or for both the latex and the colorant dispersion.

Embodiments of the present invention include a process for the preparation of toner comprised of polymer and colorant, especially pigment comprising (O) the preparation, or provision of a latex emulsion comprising submicron resin particles, such as styrene, butylacrylate, acrylic acid, which are in the size diameter range of from about 0.05 to about 0.3 microns in volume average diameter in the presence of the cleavable or hydrolyzable nonionic surfactant (hydrolyzing the cleavable surfactant involves the addition of water across a chemical bond in the form of, for example, water or hydroxide ions, and wherein heating can be selected to increase the speed of the hydrolysis); an ionic surfactant, a water soluble initiator and a chain transfer agent, (i) blending an aqueous colorant like a pigment dispersion containing an ionic surfactant with the latex emulsion containing the nonionic surfactant and an ionic surfactant with a charge polarity opposite to that of the ionic surfactant in the pigment dispersion;

(ii) heating the resulting mixture at a temperature about 25° C. to about 1° C. below the Tg (glass transition temperature) of the latex polymer to form toner sized aggregates;

(iii) subsequently stabilizing the aggregates with anionic surfactant and heating the stabilized aggregate suspension to a temperature of about 85° C. to about 95° C. to effect coalescence or fusion of the components of aggregates to enable formation of integral toner particles comprised of polymer, colorant, especially pigment and optional additives; and (iv) isolating the toner product by, for example, filtration, followed by washing and drying.

More specifically, the present invention is directed to processes for the preparation of toner compositions, which comprise (i) preparing an ionic pigment mixture by dispersing a colorant, especially pigment, such as carbon black, HOSTAPERM PINK™, or PV FAST BLUE™, in an aqueous surfactant solution containing a cationic surfactant, such as dialkylbenzene dialkylammonium chloride like SANIZOL B-50™ available from Kao or MIRAPOL™ available from Alkaril Chemicals, by means of a high shearing device such as a Brinkmann Polytron or IKA homogenizer; (ii) adding the aforementioned colorant, especially pigment mixture, to a latex emulsion of polymer particles of, for example, poly(styrene-butyl acrylate-acrylic acid), poly (styrene-butadiene-acrylic acid), and the like, an anionic surfactant, such as sodium dodecylsulfate, dodecylbenzene sulfonate or NEOGEN™, and the cleavable or hydrolyzable nonionic surfactant of the formulas illustrated herein, or mixtures thereof, thereby causing a flocculation of pigment, polymer particles and optional additives; (iii) homogenizing the resulting flocculent mixture with a high shearing device, such as a Brinkmann Polytron or IKA homogenizer, and further stirring with a mechanical stirrer at a temperature of about 1° C. to about 25° C. below the Tg of the latex polymer to form toner sized aggregates of from about 2 microns to about 12 microns in volume average diameter; (iv) and heating the mixture in the presence of additional anionic surfactant at a temperature of 95° C. or below for a duration of, for example, from about 1 to about 5 hours to form 2 to 10 micron toner particles with a particle size distribution of from about 1.15 to about 1.35 as measured by the Coulter Counter; and (v) isolating the toner particles by filtration, washing, and drying. Additives to improve flow characteristics and charge additives, if not initially present, to improve charging characteristics may then be added by blending with the formed toner, such additives including AEROSILS® or silicas, metal oxides like tin, titanium and the like, metal salts of fatty acids like zinc stearate, mixtures thereof, and the like, and which additives are present in various effective amounts, such as from about 0.1 to about 10 percent by weight of the toner for each additive.

Illustrative examples of specific latex resin, polymer or polymers selected for the process of the present invention include known polymers such as poly(styrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-butylacrylate), poly(styrene-butadiene), poly (styrene-isoprene), poly(styrene-butyl methacrylate), poly (styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and the like. The latex polymer, or resin is generally present in the toner compositions of the present invention in various suitable amounts, such as from about 75 weight percent to about 98, or from about 80 to about 95 weight percent of the toner, and the latex size suitable for the processes of the present invention can be, for example, from about 0.05 micron to about 1 micron in volume average diameter as measured by the Brookhaven nanosize particle analyzer. Other sizes and effective amounts of latex polymer may be selected in embodiments. The total of all toner components, such as resin and colorant, is about 100 percent, or about 100 parts.

The polymer selected for the process of the present invention is preferably prepared by emulsion polymerization methods, and the monomers utilized in such processes include, for example, styrene, acrylates, methacrylates, butadiene, isoprene, acrylic acid, methacrylic acid, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference, mechanical grinding processes, or other known processes. Also, the reactant initiators, chain transfer agents, and the like as disclosed in U.S. Ser. No. 922,437, pending the disclosure of which is totally incorporated herein by reference, can be selected for the processes of the present invention.

Various known colorants, such as pigments, selected for the processes of the present invention and present in the toner in an effective amount of, for example, from about 1 to about 20 percent by weight of toner, and preferably in an amount of from about 3 to about 10 percent by weight, that can be selected include, for example, carbon black like REGAL 330®; magnetites, such as Mobay magnetites MO8029™, M08060™; Columbian magnetites; MAPICO BLACKS™ and surface treated magnetites; Pfizer magnetites CB4799™, CB530™, CB560™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2, 5-di methoxy-4-sulfonanilide phenylazo-4'-chloro-2, 5-dimethoxy acetoacetanilide, and Permanent Yellow FGL. Colored magnetites, such as mixtures of MAPICO BLACK™, and cyan components may also be selected as pigments with the process of the present invention.

Colorants, include pigment, dye, mixtures of pigment and dyes, mixtures of pigments, mixtures of dyes, and the like.

Examples of initiators selected for the processes of the present invention include water soluble initiators such as ammonium and potassium persulfates in suitable amounts, such as from about 0.1 to about 8 percent and preferably in the range of from about 0.2 to about 5 percent (weight percent). Examples of organic soluble initiators include Vazo peroxides, such as Vazo 64, 2-methyl 2-2'-azobis propanenitrile, Vazo 88, 2-2'-azobis isobutyramide dehydrate in a suitable amount, such as in the range of from about 0.1 to about 8 percent. Examples of chain transfer agents include dodecane thiol, octane thiol, carbon tetrabromide and the like in various suitable amounts, such as in the range amount of from about 0.1 to about 10 percent and preferably in the range of from about 0.2 to about 5 percent by weight of monomer.

Surfactants in effective amounts of, for example, from about 0.01 to about 15, or from about 0.01 to about 5 weight percent of the reaction mixture in embodiments include, for example, anionic surfactants, such as for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, cationic surfactants, such as for example dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, in effective amounts of, for example, from about 0.01 percent to about 10 percent by weight. Preferably, the molar ratio of the cationic surfactant used for flocculation to the anionic surfactant used in the latex preparation is in the range of from about 0.5 to 4.

Examples of surfactants, which can be added to the aggregates prior to coalescence is initiated can be selected from anionic surfactants, such as for example sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™, and hydrolyzable or cleavable nonionic surfactants of the formulas illustrated herein, such as poly(ethylene glycol) methyl p-tert-octylphenyl phosphate, wherein the surfactant contains, for example, 40 ethylene glycol units, poly(ethylene glycol)-α-methyl ether-ω-methyl p-tert-octylphenyl phosphate (wherein the surfactant contains 17 ethylene glycol units). An effective amount of the anionic or nonionic surfactant utilized in the coalescence to stabilize the aggregate size against further growth with temperature is, for example, from about 0.01 to about 10 percent by weight, and preferably from about 0.5 to about 5 percent by weight of reaction mixture.

The toner may also include known charge additives in effective suitable amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, other known charge additives, and the like.

Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 2 weight percent, reference for example U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from about 0.1 to about 2 percent, which additives can be added during the aggregation or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier particles can also be comprised of a core with a polymer coating thereover, such as polymethylmethacrylate (PMMA) having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners of the present invention, reference for example a number of the patents mentioned herein, and U.S. Pat. Nos. 4,265,660; 4,858,884; 4,584,253 and 4,563,408, the disclosures of which are totally incorporated herein by reference.

The following Examples are being submitted to further define various pieces of the present invention. These Examples are intended to be illustrative only and are not intended to limit the scope of the present invention. Comparative Examples and data are also provided. The surfactants of Formulas (I) or (II) were prepared as illustrated in copending application U.S. Ser. No. (not yet assigned - D/97371), filed concurrently herewith, the disclosure of which is totally incorporated herein by reference.

EXAMPLE I

LATEX PREPARATION

A latex emulsion comprised of polymer particles generated from the emulsion polymerization of styrene, butyl acrylate and acrylic acid was prepared as follows. A mixture of 2,255 grams of styrene, 495 grams of butyl acrylate, 55.0 grams of acrylic acid, 27.5 grams of carbon tetrabromide and 96.25 grams of dodecanethiol was added to an aqueous solution prepared from 27.5 grams of ammonium persulfate in 1,000 milliliters of water and 2,500 milliliters of an aqueous solution containing 62 grams of anionic surfactant, NEOGEN R™ and 33 grams of poly(ethylene glycol)-(α-methyl ether-ω-methyl p-tert-octylphenyl phosphate hydrolyzable cleavable nonionic surfactant. The resulting mixture was homogenized at room temperature, about 25° C., under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer of poly(styrene-co butyl acrylate-co-acrylic acid) possessed an $M_w$ of 24,194, an $M_n$ of 7,212, measured by Gel Permeation Chromatography, and a mid-point Tg of 57.6° C. measured using Differential Scanning Calorimetry.

COMPARATIVE LATEX EXAMPLE 2

A latex emulsion comprised of polymer particles generated from the emulsion polymerization of styrene, butyl acrylate and acrylic acid was prepared as follows. A mixture of 2,255 grams of styrene, 495 grams of butyl acrylate, 55.0 grams of acrylic acid, 27.5 grams of carbon tetrabromide and 96.25 grams of dodecanethiol was added to an aqueous solution prepared from 27.5 grams of ammonium persulfate in 1,000 milliliters of water and 2,500 milliliters of an aqueous solution containing 62 grams of anionic surfactant, NEOGEN R™ and 33 grams of ANTAROX™ CA897. The resulting mixture was homogenized at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$ of 30,500, an $M_n$ of 5,400, measured by Gel Permeation Chromatography, and a mid-point Tg of 53° C. measured by differential scanning calorimetry.

AGGREGATION OF CYAN TONER 260.0 Grams of the latex emulsion as prepared in Example I and 220.0 grams of an aqueous cyan pigment dispersion containing 7.6 grams of cyan pigment 15.3 having a solids loading of 53.4 percent, 2.4 grams of cationic surfactant, SANIZOL B™ were simultaneously added to 400 milliliters of water with high shear stirring by means of a polytron. The mixture was transferred to a 2 liter reaction vessel and heated at a temperature of 50° C. for 2.0 hours obtaining an aggregate size of 5.9 micron and a GSD of 1.20 before 30 milliliters of 20 percent aqueous NEOGEN R™ solution was added. Subsequently, the resulting mixture was heated to 95° C. and retained there for a period of 4 hours before cooling down to room temperature, about 25 degrees Centigrade throughout, filtered, washed with water at pH 10, using KOH, and dried in a freeze dryer. The final toner product was comprised of 96.25 percent of the polymer of Example I and 3.75 percent of pigment with a toner particle size of 6.1 microns in volume average diameter and with a particle size distribution of 1.20 both as measured on a Coulter Counter. The morphology was shown to be of a potato shape by scanning electron microscopy. The toner tribo charge as determined by the Faraday Cage method throughout was −44 and −22 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein, following 2 washing steps with water.

COMPARATIVE AGGREGATION OF CYAN TONER 260.0 Grams of the latex emulsion as prepared in Comparative Example 2 and 220.0 grams of an aqueous cyan pigment dispersion containing 8.0 grams of cyan pigment 15.3 having a solids loading of 53.4 percent, and 2.4 grams of cationic surfactant SANIZOL B™ were simultaneously added to 400 milliliters of water with high shear stirring by means of a polytron. The resulting mixture was transferred to a 2 liter reaction vessel and heated at a temperature of 50° C. for 2.0 hours obtaining an aggregate size of 5.9 microns and a GSD of 1.20 before 30 milliliters of 20 percent aqueous NEOGEN R™ solution was added. Subsequently, the mixture was heated to 95° C. and held there for a period of 4 hours before cooling down to room temperature, about 25° C. throughout, filtered, washed with water at pH 10 using KOH, and dried in a freeze dryer. The final toner product of 96.25 percent of the Comparative Example 2 polymer and 3.75 percent of pigment evidenced a particle size of 6.5 microns in volume average diameter with a particle size distribution of 1.21 as measured on a Coulter Counter, and was shown to be of a potato shape by scanning electron microscopy. The toner exhibited a tribo charge of −25 and −8 μC/gram at 20 and 80 percent relative humidity, respectively, on the carrier of the above Example I. Compared to the above toner sample, the tribo measured on the comparative toner was less by 19 μC/gram at 20 percent relative humidity and by 14 μC/gram at 80 percent relative humidity. Low toner tribo charge, such as −8, generates images with low resolution.

The ANTAROX™ adsorbs water, it is believed, thus preventing high toner triboelectric charge. With the invention hydrolyzable surfactant, the long polyethylene oxide chain is no longer present on the toner surface, thus preventing adsorption of water.

AGGREGATION OF YELLOW TONER 260.0 Grams of the latex emulsion as prepared in Example I and 220.0 grams of an aqueous yellow pigment dispersion containing 32 grams of Yellow Pigment 17 having a solids loading of 28.8 percent, and 2.4 grams of cationic surfactant SANIZOL B™ were simultaneously added to 400 milliliters of water with high shear stirring by means of a polytron. The resulting mixture was transferred to a 2 liter reaction vessel and heated at a temperature of 50° C. for 2.0 hours obtaining an aggregate size of 5.8 microns and a GSD of 1.19 before 30 milliliters of 20 percent aqueous NEOGEN R™ solution was added. Subsequently, the mixture was heated to 93° C. and held there for a period of 3 hours before cooling down to room temperature, filtered, washed with water, and dried in a freeze dryer. The final toner product of 92 percent Example I polymer and 8 percent Yellow Pigment 17 evidenced a particle size of 6.4 microns in volume average diameter with a particle size distribution of 1.22 as measured on a Coulter Counter, and was shown to be smooth and spherical in shape by scanning electron microscopy. The toner exhibited a tribo charge of −38 and −17 μC/gram at 20 and 80 percent relative humidity, respectively.

COMPARATIVE AGGREGATION OF YELLOW TONER 260.0 Grams of the latex emulsion as prepared in Comparative Example 2 and 220.0 grams of an aqueous yellow pigment dispersion containing 32 grams of Yellow Pigment 17, having a solids loading of 28.8 percent, and 2.4 grams of cationic surfactant SANIZOL B™ were simultaneously added to 400 milliliters of water with high shear stirring by means of a polytron. The resulting mixture was transferred to a 2 liter reaction vessel and heated at a temperature of 50° C. for 2.0 hours obtaining an aggregate size of 5.9 microns and a GSD of 1.22 before 30 milliliters of 20 percent aqueous NEOGEN R™ solution were added. Subsequently, the mixture was heated to 93° C. and held there for a period of 3 hours before cooling down to room temperature, filtered, washed with water, and dried in a freeze dryer. The final toner product of 92 percent polymer and 8 percent Pigment Yellow 17 evidenced a particle size of 6.3 microns in volume average diameter with a particle size distribution of 1.21 as measured on a Coulter Counter, and was shown to be smooth and spherical in shape by scanning electron microscopy. The toner exhibited a low tribo charge of −13 and −5 μC/gram at 20 and 80 percent relative humidity, respectively. Compared to the above invention yellow toner Example, the tribo measured on the comparative toner was less by 25 μC/gram at 20 percent relative humidity and by 12 μC/gram at 80 percent relative humidity.

AGGREGATION OF MAGENTA TONER 260.0 Grams of the latex emulsion as prepared in Example I and 220.0 grams of an aqueous magenta pigment dispersion containing 32 grams of Magenta Pigment R81:3 having a solids loading of 21 percent, and 2.4 grams of cationic surfactant SANIZOL B™ were simultaneously added to 400 milliliters of water with high shear stirring by means of a polytron. The resulting mixture was transferred to a 2 liter reaction vessel and heated at a temperature of 50° C. for 2.0 hours obtaining an aggregate size of 5.9 microns and GSD of 1.20 before 30 milliliters of 20 percent aqueous NEOGEN R™ solution were added. Subsequently, the mixture was heated to 93° C. and held there for a period of 3 hours before cooling down to room temperature, filtered, washed with water, and dried in a freeze dryer. The final toner product of 95 percent polymer and 5 percent Pigment Red 81:3 evidenced a particle size of 6.0 microns in volume average diameter with a particle size distribution of 1.20 as measured on a Coulter Counter, and was shown to be of potato shape by scanning electron microscopy. The toner exhibited a tribo charge of −30 and −13 μC/gram at 20 and 80 percent relative humidity, respectively.

Toner tribo was obtained by mixing in all instances the toner with carrier as indicated herein in Example I.

COMPARATIVE AGGREGATION OF MAGENTA TONER 260.0 Grams of the latex emulsion as prepared in Example 2 and 220.0 grams of an aqueous magenta pigment dispersion containing 32 grams of magenta Pigment R81:3 having a solids loading of 21 percent, and 2.4 grams of cationic surfactant SANIZOL B™ were simultaneously added to 400 milliliters of water with high shear stirring by means of a polytron. The mixture was transferred to a 2 liter reaction vessel and heated at a temperature of 50° C. for 2.0 hours obtaining an aggregate size of 5.9 microns with GSD of 1.21 before 30 milliliters of 20 percent aqueous NEOGEN R™ solution were added. Subsequently, the resulting mixture was heated to 93° C. and held there for a period of 4 hours before cooling down to room temperature, filtered, washed with water, and dried in a freeze dryer. The final toner product of 95 percent polymer and 5 percent red pigment evidenced a particle size of 6.3 microns in volume average diameter with a particle size distribution of 1.21 as measured on a Coulter Counter, and was shown to be of potato shape by scanning electron microscopy. The toner exhibited tribo charge of −8 and −4 μC/gram at 20 and 80 percent relative humidity, respectively. Compared to the above magenta toner Example, the tribo measured on the comparative toner is less by 22 μC/gram at 20 percent relative humidity and by 9 μC/gram at 80 percent relative humidity.

AGGREGATION OF BLACK TONER 260.0 Grams of the latex emulsion as prepared in Example I and 220.0 grams of an aqueous black pigment dispersion containing 32 grams of carbon black REGAL 330® pigment having a solids loading of 21 percent, and 2.4 grams of cationic surfactant SANIZOL B™ were simultaneously added to 400 milliliters of water with high shear stirring by means of a polytron. The resulting mixture was transferred to a 2 liter reaction vessel and heated at a temperature of 50° C. for 2.0 hours obtaining an aggregate size of 6.2 microns and GSD of 1.22 before 30 milliliters of 20 percent aqueous NEOGEN R™ solution were added. Subsequently, the mixture was heated to 93° C. and held there for a period of 3 hours before cooling down to room temperature, filtered, washed with water, and dried in a freeze dryer. The final toner product of 95 percent polymer and 5 percent 330 carbon black pigment evidenced a particle size of 6.6 microns in volume average diameter with a particle size distribution of 1.22 as measured on a Coulter Counter, and was shown to be of potato shape by scanning electron microscopy. The toner exhibited a tribo charge of −35 and −15 μC/gram at 20 and 80 percent relative humidity, respectively.

COMPARATIVE AGGREGATION OF BLACK TONER 260.0 Grams of the latex emulsion as prepared in Example 2 and 220.0 grams of an aqueous black pigment dispersion containing 32 grams of carbon black REGAL 330® pigment having a solids loading of 21 percent, and 2.4 grams of cationic surfactant SANIZOL B™ were simultaneously added to 400 milliliters of water with high shear stirring by means of a polytron. The resulting mixture was transferred to a 2 liter reaction vessel and heated at a temperature of 50° C. for 2.0 hours obtaining an aggregate size of 6.2 microns and GSD of 1.21 before 30 milliliters of 20 percent aqueous NEOGEN R™ solution was added. Subsequently, the mixture was heated to 93° C. and held there for a period of 4 hours before cooling down to room temperature, filtered, washed with water, and dried in a freeze dryer. The final toner product of 95 percent polymer and 5 percent carbon black pigment evidenced a particle size of 6.4 microns in volume average diameter with a particle size distribution of 1.22 as measured on a Coulter Counter, and was shown to be of potato shape by scanning electron microscopy. The toner exhibited a tribo charge of −35 and −15 μC/g at 20 and 80 percent relative humidity, respectively. Compared to the above toner invention black toner Example, the tribo measured on the comparative toner is less by 25 μC/g at 20 percent relative humidity and by 11 μC/g at 80 percent relative humidity.

PREPARATION OF SURFACTANTS

EXAMPLE I

Synthesis of Poly(ethylene glycol) Methyl 4-tert-octylphenyl Phosphate (XI) wherein m is about 40:

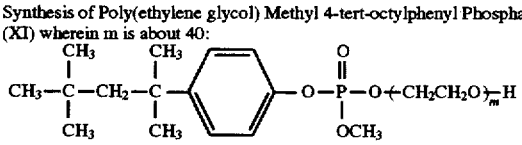

(XI)

Preparation of 4-tert-octylphenyl dichlorophosphate

In a 500 milliliter round bottomed flask equipped with a magnetic stirrer and fitted with a reflux condenser, which was connected to a magnesium sulfate dry tube, were placed 25.0 grams (0.121 mole) of 4-tert-octylphenol, 57 grams (0.372 mole) of phosphorus oxychloride, and 0.35 gram (0.0036 mole) of magnesium chloride. The reaction mixture resulting was then heated to a reflux temperature of 110° C. and maintained at this temperature for 6 hours. The unreacted phosphorus oxychloride was distilled off and the reaction mixture was cooled to room temperature, about 25° C., to provide an oily mixture which contains 39.8 grams of 4-tert-octylphenyl dichlorophosphate.

In a 3 liter round bottomed flask equipped with a mechanical stirrer and fitted with an 100 milliliter addition funnel were added the 4-tert-octylphenyl dichlorophosphate as prepared above and 250 milliliters of anhydrous toluene, while in the addition funnel were placed 3.9 grams (0.121 mol) of methanol and 9.6 grams (0.121 mol) of pyridine. The flask was cooled with an ice bath and the mixture of methanol and pyridine was added through the addition funnel over a period of 0.5 hour. After the addition, the reaction mixture was stirred for an additional 1.0 hour. Into this mixture were added a solution of 182 grams of poly(ethylene glycol) obtained from Aldrich Chemicals and with an average molecular weight $M_w$ of 1,500, in 500 milliliters of anhydrous toluene and then followed by the addition of 9.6 grams of pyridine. After stirring for 0.5 hour, the ice bath was removed, and the reaction mixture was stirred for 12 hours. The precipitated pyridine hydrochloride solids were filtered off and the liquid mixture was concentrated by distilling the volatile materials to yield 195 grams of a waxy solid. The surfactant composition product (XI) was characterized by proton NMR. The chemical shifts in $CDCl_3$ are: 0.7 (s), 1.36 (s), 1.72 (s), 3.66 (m, PEG backbone), 3.84 (d), 4.27 (m), 7.12 (d), 7.31 (d).

EXAMPLE II

Synthesis of Poly(ethylene glycol) α-Methyl Ether ω-Methyl 4-tert-octylphenyl Phosphate (XII) Wherein m is about 17:

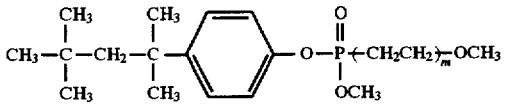

(XII)

In a one liter round bottomed flask equipped with a magnetic stirrer and fitted with a reflux condenser, which condenser was connected to a magnesium sulfate dry tube, were placed 250 milliliters of anhydrous toluene and 100 grams of poly(ethyleneglycol) monomethyl ether with an average molecular weight of 750. The flask was cooled with an ice bath, and to the stirred mixture there were added 45 grams (0.139 mol) of 4-tert-octylphenyl dichlorophosphate and 11 grams (0.139 mol) of pyridine. After 0.5 hour, the ice bath was removed and the reaction mixture was stirred at room temperature for 5.0 hours. The reaction was completed by adding 20 milliliters of methanol and 11.0 grams of pyridine, and the stirring was maintained for another 3.0 hours. The precipitated pyridine hydrochloride solids were removed by filtration, and the filtrate was concentrated under reduced pressure to yield 125 grams of a liquid. The surfactant composition product (XII) was characterized by proton NMR. The chemical shifts in $CDCl_3$ are: 0.7 (s), 1.36 (s), 1.71 (s), 3.38 (s), 3.66 (m, PEG backbone), 3.85 (d), 4.27 (m), 7.12 (d), 7.34 (d).

EXAMPLE III

Synthesis of Bis[poly(ethylene glycol)] α-Methyl Ether ω-Methyl 4-tert-octylphenyl Phosphate (XII) Wherein m is about 17:

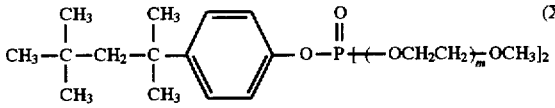

(XIII)

In a one liter round bottomed flask equipped with a magnetic stirrer and fitted with a reflux condenser, which was connected to a magnesium sulfate dry tube, were placed 150 milliliters of anhydrous toluene and 110 grams of poly(ethyleneglycol)monomethyl ether with an average molecular weight of 750. The flask was cooled with an ice bath, and to the stirred mixture there were added 22.6 grams (0.07 mol) of 4-tert-octylphenyl dichlorophosphate and 1 1.0 grams (0.139 mol) of pyridine. After 0.5 hour, the ice bath was removed and the reaction mixture was stirred at room temperature for 5.0 hours. The precipitated pyridine hydrochloride solids were removed by filtration, and the liquid filtrate was concentrated under reduced pressure to yield 118 grams of a waxy solid. The surfactant composition product (XIII) was characterized by proton NMR. The chemical shifts in $CDCl_3$ are: 0.7 (s), 1.36 (s), 1.70 (s), 3.39 (s), 3.66 (m, PEG backbone), 4.27 (m), 7.10 (d), 7.35 (d).

EXAMPLE IV

Synthesis of Bis[poly(ethylene glycol)] α-Methyl Ether ω-Methyl 4-Tert-octylphenyl Phosphate (XIII) Wherein M is about 40:

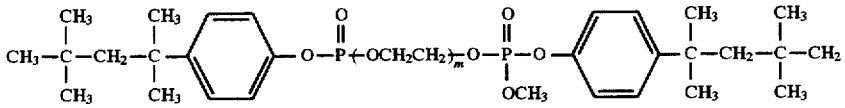

(XIII)

In a 3 liter round bottomed flask equipped with a mechanical stirrer and fitted with an 100 milliliters addition funnel, were added the 4-tert-octylphenyl dichlorophosphate as prepared above and 250 milliliters of anhydrous toluene, while in the addition funnel were placed 3.9 grams (0.121 mol) of methanol and 9.6 grams (0.121 mol) of pyridine. The flask was cooled with an ice bath and the mixture of methanol and pyridine was added through the addition funnel over a period of 0.5 hour. After the addition, the reaction mixture was stirred for an additional 1.0 hour. Into this mixture was added a solution of 90 grams of poly(ethylene glycol) with an average molecular weight of 1,500 in 500 milliliters of anhydrous toluene and there followed by 20 grams of pyridine. After stirring for 0.5 hour, the ice bath was removed, and the reaction mixture was stirred for 12.0 hours. The precipitated pyridine hydrochloride solids were filtered off and the liquid mixture remaining was concentrated by distilling the volatile materials to yield 115 grams of a liquid. The surfactant composition product (XIV) was characterized by proton NMR. The chemical shifts in $CDCl_3$ are: 0.71 (s), 1.37 (s), 1.72 (s), 3.67 (m, PEG backbone), 3.85 (d), 4.27 (m), 7.12 (d), 7.32 (d).

EXAMPLES V AND VI

Examples II and III were repeated substituting, respectively, a poly(ethylene glycol) monomethyl ether with an average molecular weight of 2,000 for the poly(ethylene glycol) monomethyl ether of Examples II and III. There were obtained nonionic surfactants (XV) and (XVI) whose structures are represented by Formulas (XII) and (XIII), wherein m is about 45, respectively. The chemical shifts of surfactant (XV) in $CDCl_3$ are: 0.7 (s), 1.35 (s), 1.71 (s), 3.37 (s), 3.67 (m, PEG backbone), 3.84 (d), 4.27 (m), 7.12 (d), 7.33 (d). The chemical shifts of surfactant (XVI) in $CDCl_3$ are: 0.69 (s), 1.36 (s), 1.70 (s), 3.40 (s), 3.66 (m, PEG backbone), 4.26 (m), 7.10 (d), 7.34 (d).

EXAMPLE VII

Example II was repeated substituting dodecylphenol for the 4-tert-octylphenol of Example II, resulting in the surfactant (XVII) wherein m is about 17.

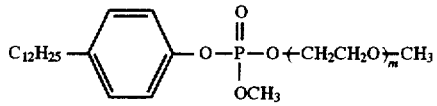

(XVII)

The chemical shifts of surfactant (XVII) in $CDCl_3$ are: 0.85 (t), 1.30 (m), 2.51(t), 3.38 (s), 3.66 (m, PEG backbone), 3.85 (d), 4.27 (m), 7.10 (d), 7.34 (d).

Other modifications of the present invention may occur to those skilled in the art subsequent to a review of the present application and these modifications, including equivalents thereof, are intended to be included within the scope of the present invention.

What is claimed is:

1. A process for the preparation of toner comprising mixing a colorant dispersion and a latex emulsion, and wherein the latex emulsion contains resin and a surfactant, and wherein the surfactant is of the Formulas (I) or (II), or optionally mixtures thereof

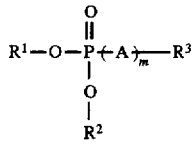

(I)

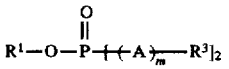

(II wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments, forming aggregates from the mixture of said colorant dispersion and said latex emulsion, and coalescing said aggregates.

2. A process in accordance with claim 1 wherein $R^1$ is a hydrophobic moiety of alkyl or aryl; said aggregates are formed by heating below about or equal to about the resin latex glass transition temperature and said aggregates are coalesced by heating above about or equal to about the resin glass transition temperature.

3. A process in accordance with claim 2 wherein $R^1$ is alkyl, m is a number of from about 2 to about 60, and said A hydrophilic polymer is a poly(oxyalkylene glycol) selected from the group consisting of a branched polyoxyalkylene glycol, a block polyoxyalkylene glycol and a homopolymeric polyoxyalkylene glycol.

4. A process in accordance with claim 2 wherein m is a number of from about 5 to about 60, or from about 10 to about 50.

5. A process in accordance with claim 2 wherein the weight average molecular weight of A is from about 100 to about 3,000.

6. A process in accordance with claim 2 wherein $R^1$ is methylphenyl, ethylphenyl, propylphenyl, butylphenyl, pentylphenyl, hexylphenyl, octylpenyl, or nonylphenyl; $R^2$ is hydrogen, methyl, ethyl, methylphenyl, or propyl; $R^3$ is methyl, ethyl, propyl, or butyl; and A is polyoxyalkylene glycol, polyethylene glycol, or polypropylene glycol.

7. A process in accordance with claim 2 wherein $R^1$ is an alkylaryl group, or an alkylaryl group with a substituent of fluorine, chlorine, or bromine, wherein alkyl contains from about 2 to about 30 carbon atoms; $R^2$ alkyl contains from 1 to about 30 carbon atoms; $R^3$ alkyl contains from 1 to about 3 carbon atoms; and wherein A is a hydrophilic poly (oxyalkylene glycol) selected from the group consisting of a branched, block or homopolymeric polyoxyalkylene glycol derived from alkylene oxides with from about 2 to about 4 carbon atoms.

8. A process in accordance with claim 2 wherein the latex resin is generated from the polymerization of monomers to provide a latex emulsion with submicron resin particles in the size range of from about 0.05 to about 0.3 micron in volume average diameter and wherein the latex contains an ionic surfactant, a water soluble initiator and a chain transfer agent; adding anionic surfactant to retain the size of the toner aggregates formed; thereafter coalescing or fusing said aggregates by heating; and optionally isolating, washing, and drying the toner.

9. A process in accordance with claim 8 wherein isolating, washing and drying is accomplished.

10. A process in accordance with claim 2 wherein said surfactant is mixed with a basic solution in the pH range of from about 8 to about 13.

11. A process in accordance with claim 10 wherein said basic medium, or solution is in the pH range of from about 8.5 to about 12.

12. A process in accordance with claim 2 wherein $R^1$ is a an alkylaryl, or an alkylaryl group with a substituent of fluorine, chlorine, or bromine, wherein alkyl contains from about 2 to about 30 carbon atoms; $R^2$ is an alkyl containing from about 1 to about 30 carbon atoms, $R^3$ is a hydrogen or an alkyl of from about 1 to about 3 carbon atoms; wherein A is a poly(ethylene glycol); and wherein the molecular weight $M_w$ of A is from about 104 to about 2,500.

13. A process in accordance with claim 2 wherein $R^2$ is an alkylphenyl with an alkyl of about 4 to about 30 carbon atoms, or wherein $R^2$ is an alkyl with from 1 to about 6 carbon atoms.

14. A process in accordance with claim 13 wherein said alkylphenyl is an octylphenyl, and $R^2$ is a methyl.

15. A process in accordance with claim 7 herein $R^2$ is hydrogen or methyl, and wherein said poly(ethylene glycol) has a number of repeat units of from about 4 to about 50.

16. A process in accordance with claim 2 wherein said surfactant is selected in an amount of from about 0.05 to about 10 weight percent based on the amount of monomer selected to generate said resin latex.

17. A process in accordance with claim 2 wherein said surfactant is cleavable, or hydrolyzable, and is selected in an amount of from about 1 to about 3 weight percent.

18. A process in accordance with claim 2 wherein the temperature at which said aggregation is accomplished controls the size of the aggregates, and wherein the final toner size is from about 2 to about 15 microns in volume average diameter.

19. A process in accordance with claim 8 wherein the aggregation temperature is from about 45° C. to about 55° C., and wherein the coalescence or fusion temperature is from about 85° C. to about 95° C.

20. A process in accordance with claim 8 wherein the colorant is a pigment and wherein said pigment dispersion contains an ionic surfactant, and the latex emulsion contains said surfactant and which surfactant is a cleavable nonionic surfactant of Formulas I or II, and an ionic surfactant of opposite charge polarity to that of ionic surfactant present in said colorant dispersion.

21. A process in accordance with claim 8 wherein the surfactant utilized in preparing the colorant dispersion is a cationic surfactant, and the ionic surfactant present in the latex mixture is an anionic surfactant; wherein the aggregation is accomplished at a temperature of about 15° C. to about 1° C. below the Tg of the latex resin for a duration of from about 0.5 hour to about 3 hours; and wherein the coalescence or fusion of the components of aggregates for the formation of integral toner particles comprised of colorant, and resin additives is accomplished at a temperature of from about 85° C. to about 95° C. for a duration of from about 1 hour to about 5 hours.

22. A process in accordance with claim 2 wherein the latex resin, or polymer is selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid).

23. A process in accordance with claim 2 wherein the latex resin is selected from the group consisting of poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); and wherein said colorant is a pigment.

24. A process in accordance with claim 8 wherein the anionic surfactant is selected from the group consisting of sodium dodecyl sulfate, sodium dodecylbenzene sulfate and sodium dodecylnaphthalene sulfate.

25. A process in accordance with claim 2 wherein the colorant is carbon black, cyan, yellow, magenta, or mixtures thereof.

26. A process in accordance with claim 8 wherein the toner particles isolated are from about 2 to about 10 microns in volume average diameter, and the particle size distribution thereof is from about 1.15 to about 1.30, wherein the ionic surfactant utilized represents from about 0.01 to about 5 weight percent of the total reaction mixture.

27. A process in accordance with claim 2 wherein there is added to the surface of the formed toner metal salts, metal salts of fatty acids, silicas, metal oxides, or mixtures thereof, each in an amount of from about 0.1 to about 10 weight percent of the obtained toner particles.

28. A process for the preparation of toner which comprises mixing a resin latex, an ionic surfactant and colorant, and a surfactant of the Formulas (I), or (II); heating the resulting mixture below about, or equal to about the glass transition temperature of the resin; thereafter heating the resulting aggregates above about, or about equal to the glass transition temperature of the resin; and optionally isolating, washing and drying the toner.

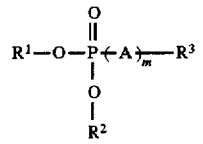

(I)

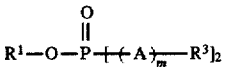

(II wherein $R^1$ is a hydrophobic group; $R^2$ is selected from the group consisting of hydrogen, alkyl, aryl, alkylaryl, and alkylarylalkyl; $R^3$ is hydrogen or alkyl; A is a hydrophilic segment; and m represents the number of A segments.

29. A process in accordance with claim 28 wherein said toner is isolated, washed and dried, and said toner is of a volume average diameter of from about 1 to about 20 microns.

30. A process in accordance with claim 29 comprising the preparation, or provision of a latex emulsion comprised of resin particles in the size range of from about 0.5 to about 3 microns containing a cleavable or hydrolyzable nonionic surfactant of the Formulas (I), or (II), an ionic surfactant, a water soluble initiator and a chain transfer agent; aggregating a colorant dispersion with said latex emulsion and optional additives to form toner sized aggregates; freezing or maintaining the size of aggregates with an anionic surfactant; coalescing or fusing said aggregates by heating; and isolating, washing, and drying the toner.

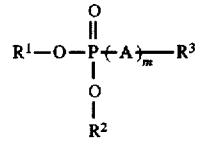

(I)

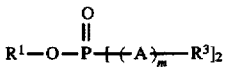

(II wherein $R^1$ is alkyl or aryl; $R^2$ is selected from the group consisting of hydrogen, alkyl and aryl; $R^3$ is hydrogen or alkyl; A is a hydrophilic segment, and m represents the number of A segments.

31. A process in accordance with claim 2 wherein the surfactant is selected from the group consisting of poly (ethylene glycol) methyl p-tert-octylphenyl phosphate, poly (ethylene glycol)-α-methyl ether-(ω-methyl p-tert-octylphenyl phosphate, poly(ethylene glycol) methyl decylphenyl phosphate, poly(ethylene glycol)-α-methyl ether-ω-methyl dodecylphenyl phosphate, poly (ethyleneglycol) methyl dodecylphenyl phosphate, bis[poly (ethylene glycol)-α-methyl ether]-ω-p-tert-octylphenyl phosphate, poly(ethylene glycol )-α, ω-methyl p-tert-octylphenyl phosphate, poly(ethylene glycol) ethyl p-tert-octylphenyl phosphate, poly(ethylene glycol)-α-methyl ether-ω-ethyl p-tert-octylphenyl phosphate, poly(ethylene glycol) phenyl p-tert-octylphenyl phosphate, poly(ethylene glycol)-α-methyl ether-ω-phenyl p-tert-octylphenyl phosphate, poly(ethylene glycol) tolyl p-tert-octylphenyl phosphate, poly(ethylene glycol)-α-methyl ether-ω-tolyl p-tert-octylphenyl phosphate, and poly(ethylene oxide-co-propylene oxide) methyl p-tert-octylphenyl phosphate, wherein the polymer chain contains from about 5 to about 50 repeating units or segments.

32. A process for the preparation of toner comprising mixing a colorant dispersion with a latex emulsion, and wherein the latex emulsion contains resin and a surfactant, and wherein the surfactant is represented by Formulas (I), (II) or (III); or optionally mixtures thereof

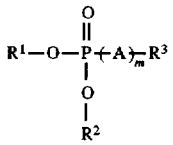

(I)

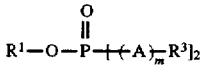

(II)

-continued

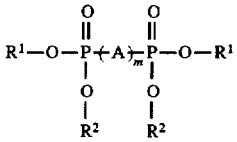

(III)

wherein $R^1$ is a hydrophobic moiety; $R^2$ is selected from the group consisting of hydrogen, alkyl and aryl; $R^3$ is hydrogen or alkyl; A is a hydrophilic polymer chain; and m is the number of repeating segments of the hydrophilic polymer chain A, forming aggregates from the mixture of said colorant dispersion and said latex emulsion, and coalescing said aggregates.

* * * * *